US005282323A

United States Patent [19]

Winheim

[11] Patent Number: 5,282,323

[45] Date of Patent: Feb. 1, 1994

[54] APPARATUS FOR CONTACTING RUNNING PAPER WEBS WITH DRIED STEAM

[75] Inventor: Stefan H. Winheim, Frankfurt, Fed. Rep. of Germany

[73] Assignee: V.I.B. Apparatebau GmbH, Maintal, Fed. Rep. of Germany

[21] Appl. No.: 919,185

[22] Filed: Jul. 23, 1992

[30] Foreign Application Priority Data

Jul. 29, 1991 [DE] Fed. Rep. of Germany ..... 4125062

[51] Int. Cl.[5] ..... F26B 13/00

[52] U.S. Cl. ..... 34/155; 34/160; 162/207

[58] Field of Search ..... 34/155, 156, 10, 37, 34/23, 160; 162/290, 207

[56] References Cited

U.S. PATENT DOCUMENTS 4,915,788 4/1990 Winheim ..... 162/207

5,059,285 10/1991 Winheim ..... 162/290

FOREIGN PATENT DOCUMENTS 2203973 8/1973 Fed. Rep. of Germany .

WO9114045 9/1991 PCT Int'l Appl. .

*Primary Examiner*—Henry A. Bennett

[57] ABSTRACT

Apparatus for directing steam against one side of a running web of fibrous material has a housing defining one or more steam chambers and having walls which surround the chamber or chambers. One of the walls is apertured and is located at the path for the web to direct jets of steam toward successive increments of the running web. The steam is dried prior to admission into the chamber or chambers via one or more adjustable valves, and at least one wall of the housing is heated by dried and/or undried steam in order to reduce the likelihood of condensation of steam in the chamber or chambers.

19 Claims, 3 Drawing Sheets

APPARATUS FOR CONTACTING RUNNING PAPER WEBS WITH DRIED STEAM

BACKGROUND OF THE INVENTION

The invention relates to improvements in apparatus for discharging fluids, and more particularly to improvements in apparatus for directing jets of a fluid, such as compressed steam, toward successive increments of a running web of paper or the like. Still more particularly, the invention relates to improvements in apparatus of the type disclosed in commonly owned U.S. Pat. Nos. 4,915,788 (granted Apr. 10, 1990) and 5,059,285 (granted Oct. 22, 1991) to Stefan H. Winheim. The disclosures of these patents are incorporated herein by reference.

The patents to Winheim disclose an apparatus wherein a housing defines a plurality of chambers each of which receives steam from a discrete valve. The housing has a wall which is adjacent one side of the path for movement of a running web of moisture-containing fibrous material. Such wall has numerous apertures which discharge jets of steam toward the running web. Additional walls of the housing are designed to cooperate with the apertured wall to completely enclose the chambers.

The purpose of the patented apparatus is to raise the temperature of the running web of fibrous material (e.g., in a paper making machine) and to thus promote expulsion of moisture from the web. The patented apparatus can be used with equal or similar advantage in certain types of paper finishing or processing machines, e.g., in so-called soft compact calenders wherein a running web of paper or the like is caused to advance through one or more nips each of which is defined by two neighboring calender rolls. It is often necessary to contact a running paper web with steam ahead of a nip in a soft compact calender wherein the web is to undergo a smoothing or another quality-improving action. The just outlined calenders employ soft rolls which are subject to wear and must be replaced or repaired at certain intervals. The period of time which is required to replace a damaged or spent soft roll in a soft compact calender is in the range of ten times n minutes wherein n normally equals or approximates two Thus, the treatment of a web must be interrupted for an interval of twenty minutes or so. In other words, the chambers of the aforementioned apparatus are sealed from the source of hot steam for an equal period of time which results in cooling and condensation of steam that remains confined in the chambers while the operation of the calender is interrupted for a period of approximately twenty minutes. Though the apparatus of Winheim are equipped with means for evacuating condensate from the chambers, a certain period of time subsequent to restarting of the calender is required in order to refill the chambers with fresh steam and to heat the condensate (if any) which has remained in the chambers in spite of the provision of the aforementioned evacuating means. Heating of the condensate results in conversion into hot steam which is ready to be directed through the apertures of the respective wall of the housing to impinge upon the running web or to be admitted into a treating zone between the outer side of the apertured wall and the adjacent side of the path for the running web. As a rule, the quantities of steam which must be directed against a running web in a soft compact calender are relatively small; therefore, the energy contents of such steam do not always suffice to ensure reconversion of condensed steam into steam which is ready to contact the running web. This results in entrainment of droplets of condensed steam by freshly admitted steam, and such droplets act not unlike small missiles or projectiles whose inertia suffices to puncture the running web. Moreover, some droplets of entrained condensed steam deposit on the surface of a soft roll and cooperate with the adjacent hard roll of the soft compact calender to perforate the web in the nip between the soft roll and the hard roll. Such undesirable circumstances are likely to prevail for a reasonably long interval of time subsequent to starting of the calender so that a rather long portion of the running web must be discarded before the expulsion of last traces of condensed steam from the chambers of the apparatus is completed.

German patent application No. 22 03 973 of Pagendarm (published Aug. 9, 1973) discloses a method of and an apparatus for moistening a running web. The apparatus of Pagendarm employs conduits which discharge steam directly against one side of the running web at a location where the other side of the web is contacted by a heated roller or by other propping means. The conduits extend along the inner side of a wall structure which surrounds a compartment. Steam which is discharged by the conduits is caused to rebound and to enter the compartment. The wall structure is or can be heated for the purpose of reducing the likelihood of condensation of steam which enters the compartment subsequent to impingement upon the running web. Alternatively, Pagendarm proposes to provide means for evacuation of condensed steam from the compartment wherein the running web is contacted by steam issuing directly from a plurality of conduits. The proposal of Pagendarm results in considerable reduction of the quantity of condensed steam which can drip onto the running web. However, such undertakings are of no assistance during starting of the apparatus of Pagendarm, i.e., steam which is discharged by the conduits when the operation of the apparatus is restarted is likely to entrain some condensate from the compartment into actual contact with the restarted web.

International patent application No. WO 91/14045 of Sawley et al. (published on Sep. 19, 1991, i.e., subsequent to the priority date of the present application) discloses a steam shower which is to be applied to the upper side of a running web. A steam supplying conduit is provided to admit steam into two channels of pipes One of these channels or pipes serves to heat a set of series-connected steam chambers, and the other channel or pipe serves to admit steam into the first chamber of the set. The apparatus of Sawley et al. exhibits the drawback that droplets of condensed steam are likely to issue from the steam supplying conduit when the operation of the apparatus is restarted. Therefore, the inventors propose to employ screens which consist of wire mesh or the like and are installed in the path of inflowing steam to serve as a means for intercepting the droplets of condensate ahead of the path for the running web. Thus, the proposal of Sawley et al. is intended to prevent existing condensate from reaching the web rather than to prevent the development of droplets of condensed steam.

OBJECTS OF THE INVENTION

An object of the invention is to provide an apparatus which renders it possible to restart the admission of steam into contact with a running web of paper or the like with a minimum of delay.

Another object of the invention is to provide an apparatus which is less likely to accumulate appreciable quantities of condensed steam during intervals of interruption of admission of fresh steam into its chamber or chambers A further object of the invention is to provide an apparatus wherein steam which flows into the chamber or chambers of the housing is treated in a novel and improved way before it actually enters the chamber or chambers.

An additional object of the invention is to provide the above outlined apparatus with a novel and improved housing for the steam confining chamber or chambers.

Still another object of the invention is to provide the apparatus with novel and improved means for conditioning steam ahead of the chamber or chambers for confinement of steam prior to discharge of steam into actual contact with a running web of paper or the like.

A further object of the invention is to provide a novel and improved method of conditioning steam ahead of the steam confining chamber or chambers in the above outlined apparatus.

Another object of the invention is to provide a novel and improved method of preventing, or reducing the likelihood of, condensation of steam in the chamber or chambers of the above outlined apparatus.

A further object of the invention is to provide a paper making machine which embodies an apparatus of the above outlined character.

An additional object of the invention is to provide a calender which embodies an apparatus of the above outlined character.

Still another object of the invention is to reduce the quantities of running web which must be discarded as a result of temporary stoppage of a calender or a paper making machine.

A further object of the invention is to provide an apparatus which can be installed in, or combined with, existing paper making or calendering machines as a superior substitute for heretofore known and used steam applying apparatus.

SUMMARY OF THE INVENTION

The invention resides in the provision of an apparatus for contacting with steam a running web (such as a running web of fibrous material in a paper making machine) which is advanced in a predetermined direction along a predetermined path. The improved apparatus comprises a housing which defines at least one steam confining chamber The housing has a first wall disposed at one side of the predetermined path and provided with apertures serving to direct steam from the at least one chamber toward the web in the predetermined path. The housing further comprises additional walls which cooperate with the first wall to enclose (preferably completely enclose) the at least one chamber, and the apparatus further comprises means for supplying steam into the at least one chamber including a valve disposed in the at least one chamber, a source of steam and means for conveying steam from the source to the valve. The apparatus also comprises steam-operated means for preferably continuously heating at least one wall of the housing in order to oppose condensation of steam in the at least one chamber. The heating means includes a steam-drying first section extending in a second direction substantially transversely of the predetermined direction, and a second section extending in a third direction substantially transversely of the predetermined direction and substantially counter to the second direction. The at least one chamber is disposed between the first and second sections, and the heating means further comprises a third section connecting the first section with the second section. Each section of the heating means can comprise a channel, and the channels can jointly define a substantially U-shaped second path for the flow of steam around the housing. The sections of the heating means can form part of the aforementioned conveying means, and the valve is connected with the heating means in such a way that it receives dried steam for admission into the at least one chamber The at least one wall may but need not be constituted by the first wall of the housing, and at least one section of the heating means is or can be adjacent the at least one wall of the housing In accordance with a presently preferred embodiment of the invention, the housing defines a plurality of neighboring chambers which are preferably arranged in a row extending substantially transversely of the predetermined direction. The additional walls of the housing in such apparatus include partitioning means between neighboring chambers, and the steam supplying means of such apparatus comprises a valve in each of the chambers. At least one section of the heating means is or can be adjacent the entire row of chambers.

At least the second section of the heating means is preferably elongated, and such heating means can further comprise means for establishing a pressure differential between the ends of the elongated section in order to cause steam to flow from the one end toward the other end.

The heating means can further comprise at least one duct which is disposed at the first wall and has an inlet receiving dried steam from one of the sections. The at least one duct can include a substantially U-shaped first portion and a second portion forming part of the first wall and defining with the first portion an elongated passage for dried steam. The apertures of the first wall can form at least two groups (e.g., two rows), and the at least one duct can be disposed between such groups of apertures.

If the housing defines a plurality of chambers and its additional walls include partitioning means between the chambers, the heating means can further comprise at least one passage which is provided in or on the partitioning means and communicatively connects the first section with the second section The first wall can be at least slightly spaced apart from the predetermined path, and the first and second sections of heating means in such apparatus can comprise portions which extend beyond the first wall toward the predetermined path.

If the housing defines a plurality of chambers, the steam supplying means can comprise an adjustable valve for each chamber The steam supplying means of such apparatus can further comprise means for adjusting the valves independently of each other.

Each valve can be provided with a plurality of steam discharging orifices or parts having axes which define angles of between 69° and 75° with at least one of the additional walls.

The additional walls can include a transverse wall which is disposed substantially opposite the first wall, and such apparatus can further comprise means for evacuating condensed steam (if any) from the at least one chamber in the region of the first wall and/or in the region of the transverse wall. The steam supplying means of such apparatus can include means for normally maintaining the steam in the at least one chamber at a predetermined pressure, and the evacuating means of such apparatus can comprise a siphon having a length which suffices to establish and maintain a column of condensed steam or another liquid which is capable of resisting the predetermined pressure of steam in the at least one chamber.

Each aperture is or can be dimensioned in such a way that its maximum dimension at most equals the thickness of the first wall of the housing. For example, if the apertures are round or nearly round, their diameters are preferably smaller than the thickness of the first wall.

The heating means can be designed to maintain the at least one wall at a temperature of between 102° and 110° C.

The novel features which are considered as characteristic of the invention are set forth in particular in the appended claims The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
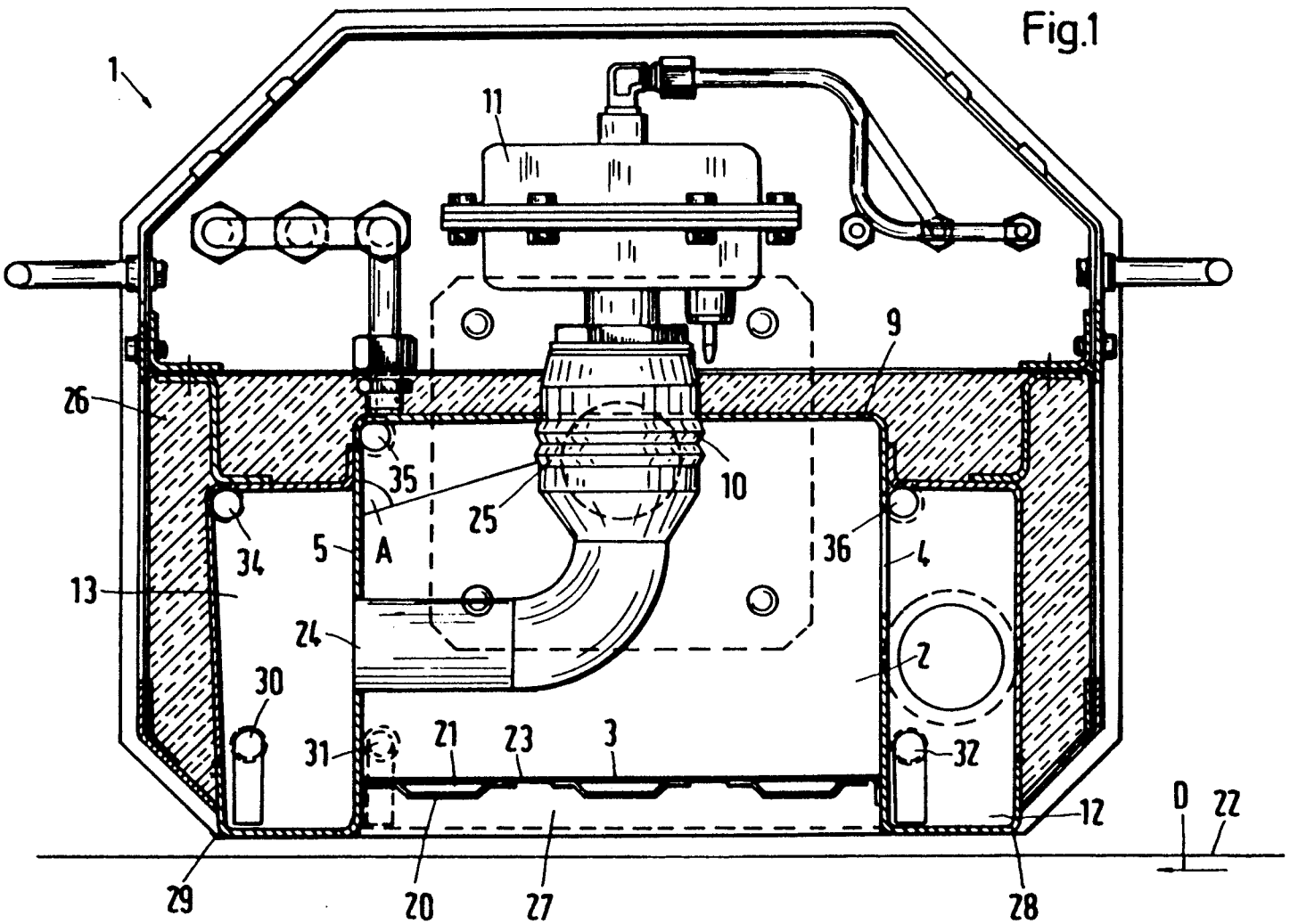
FIG. 1 is a schematic transverse sectional view of an apparatus which embodies one form of the invention and is located at one side of the path for a running web of fibrous material.
Figure 2:
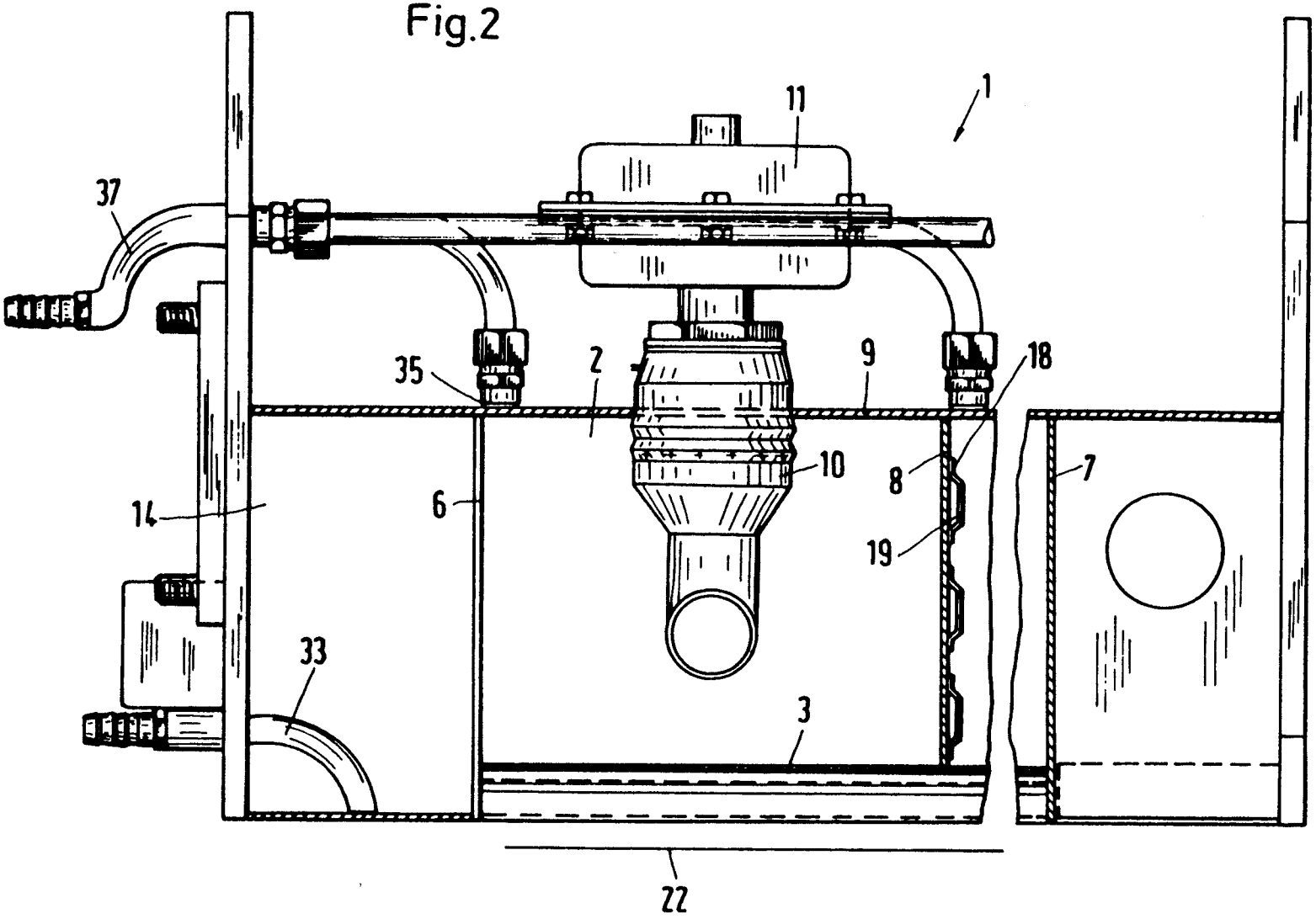
FIG. 2 is a fragmentary smaller-scale longitudinal sectional view of the apparatus which is shown in FIG. 1.
Figure 3:
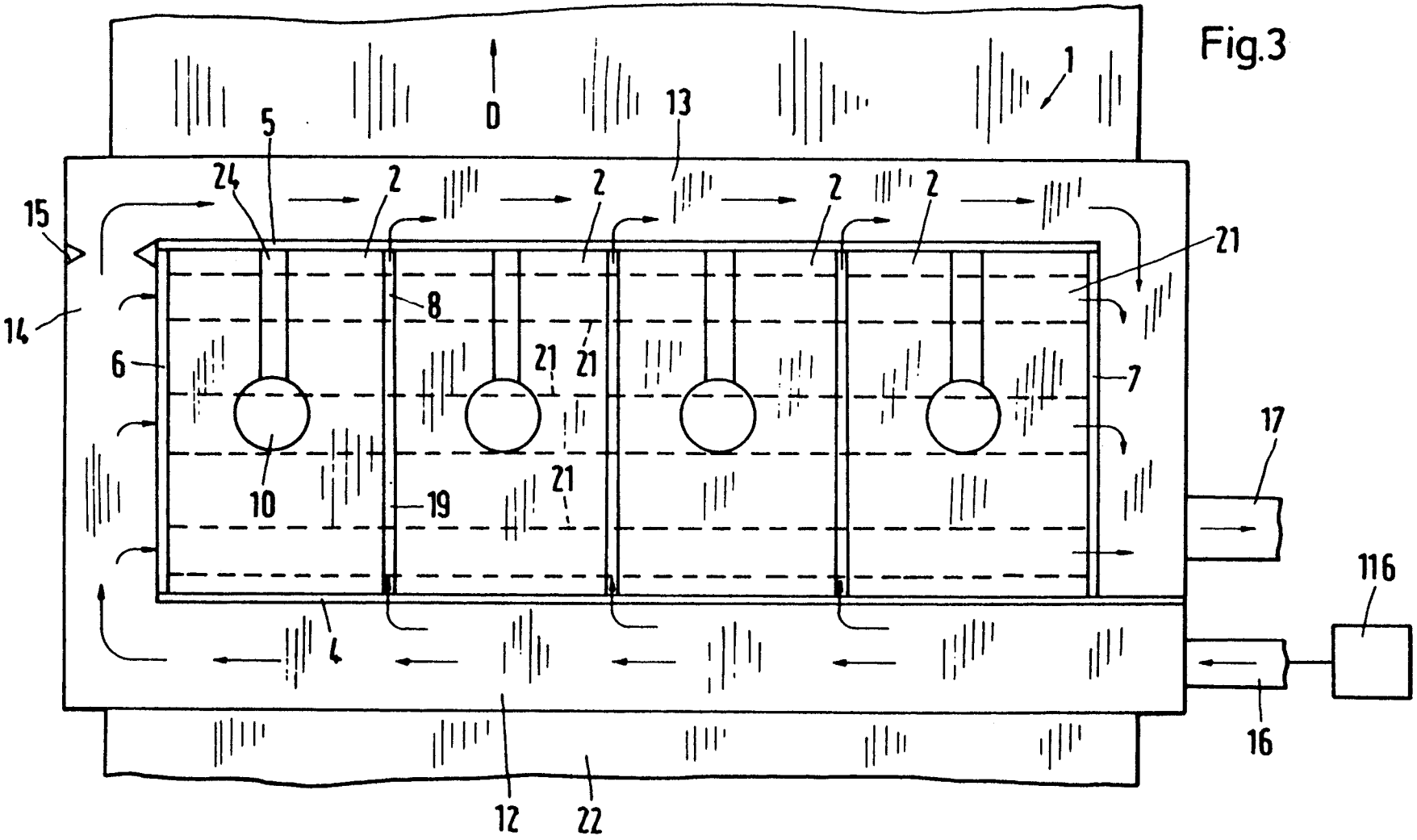
FIG. 3 is a smaller scale schematic plan view of the apparatus of FIG. 1, with the means for adjusting the steam discharging valves omitted.

The apparatus 1 which is shown in FIGS. 1 to 3 comprises a housing having a first wall 3 adjacent one side of the path for a running web 22 of moist fibrous material. The direction of transport of the web 22 (e.g., by an endless belt conveyor in a paper making machine or into the nip of two rolls in a calender) is indicated by arrow D. The housing defines a row of separate steam confining chambers 2 (FIG. 3 shows a row of four neighboring chambers), and this housing comprises additional walls 4, 5, 6, 7, 8 and 9 which cooperate with the first wall 3 and with each other to completely enclose the chambers 2. The additional walls include a front wall 4, a rear wall 5 opposite the front wall 4, two lateral walls 6, 7 which alternate with the walls 4, 5, a transverse wall 9 opposite the first wall 3, and three partitioning means 8 (hereinafter called partitions) between neighboring chambers 2.

The means for supplying steam into the chambers 2 comprises a discrete adjustable valve 10 in each chamber, a source 116 of steam, and means (including a pipe 16, three channels 12, 13 and 14, and conduits 24) for conveying steam from the source 116 to the discrete valves 10. The valves may be of the type fully described and shown in commonly owned U.S. Pat. No. 5,059,285 to Winheim. The steam supplying means further comprises discrete adjusting devices 11, one for each of the valves 10.

The channels 12, 13, 14 constitute three sections of a unit which serves to heat one or more walls 3 to 9 in order to prevent condensation of steam in the chambers 2 and/or to promote rapid heating of condensed steam, i.e., reconversion into steam which can be used to contact successive increments of the running web 22. The channels 12, 13 are substantially parallel to each other and extend transversely of the direction which is indicated by the arrow D. The chambers 2 are disposed between the channels 12, 13 and the steam discharging end of the channel 12 is connected to the steam receiving end of the channel 13 by the third channel 14. The three channels together form a substantially U-shaped composite structure which surrounds the walls 4, 5 and 6 of the housing. A throttling device 15 is provided at the steam discharging end of the channel 14 to establish a pressure differential between the two ends of the channel 13 and to thus promote the flow of steam from the channel 14 into a pipe 17 serving to withdraw spent steam and/or condensate from the heating unit. The channel 13 is or can be said to be substantially L-shaped with one leg extending along the outer side of the wall 5 and with the other leg extending along the outer side of the wall 7 all the way to the inlet of the withdrawing pipe 17. The pipe 16 forms part of the aforementioned steam conveying means in that it supplies fresh steam from the source 116 to the receiving end of the channel 12.

The throttle 15 can constitute a separately produced part which is installed in the channel 14 at the steam receiving end of the channel 13, or an integral part of the steam heating means. For example, the illustrated throttle 15 can be used jointly with or it can be replaced by a suitably configurated part of the channel 14 and/or 13 which ensures that steam supplied by the channel 12 is compelled to flow in the channel 13 toward and into the pipe 17 as well as into conduits 24, i.e., into the valves 10. The streams of steam in the channels 12 and 13 exchange heat with the adjacent walls 4, 5 which, in turn, exchange heat with the bodies of steam in the chambers 2. Steam flowing in the channel 14 exchanges heat with the wall 6, and steam flowing in the right-hand portion of the channel 13 (as viewed in FIG. 3) exchanges heat with the wall 7. The flow of steam in the channel 12 is counter to the direction of flow of steam in the conduit 13, and the streams of steam in the channels 12, 13 flow transversely of the direction (arrow D) of transport of the web 22 along its path in front of but preferably spaced apart from the adjacent side of the web.

In accordance with a further feature of the invention, the partitions 8 between neighboring chambers 2 are heated by streams of steam flowing in ducts 19 (FIG. 2) which define passages for the flow of steam between the channels 12 and 13. Each duct 19 includes a substantially U-shaped portion 18 and the adjacent portion of the respective partition 8. The legs of the U-shaped portions 18 are or can be welded to one side of the respective partition 8. The passages which are defined by the ducts 19 are preferably sealed from the respective chambers 2 so that steam which is admitted into the chambers through the respective adjustable valves 10 cannot mix with steam in the ducts 19.

FIG. 1 shows ducts 21 which are similar to the ducts 19 but are provided at the exposed side of the first wall 3. Each duct 21 comprises a substantially U-shaped portion 20 and the adjacent portion of the first wall 3. The latter is provided with groups or sets of apertures 23 which serve to discharge steam from the chambers 2 into a treating zone 27 between the first wall 3 and the adjacent side of the running web 23. At least the median duct 21 of FIG. 1 is flanked by two groups of apertures 23, and each duct 21 extends transversely of the direction (arrow D) of transport of the web 22 along its path and across the full width of the chambers 2 (as measured in the longitudinal direction of the walls 4 and 5). The ducts 21 can further serve as a substitute for the throttle 15, i.e., they can induce the flow of dried steam from the channel 12 into and in the channel 13 as well as into and in the conduits 24 leading to the respective valves 10. Steam which flows in the ducts 21 at the outer side of the first wall 3 cannot mix with steam which enters the treating zone 27 through the apertures 23 of the first wall 3. The thickness of the first wall 3 is preferably selected in such a way that it at least matches but preferably exceeds the maximum dimensions of the apertures 23. If the apertures 23 are round or nearly round, the thickness of the first wall 3 preferably exceeds the diameters of such apertures.

The direction of flow of steam in the channels 12, 13, 14, in the ducts 19 at the partitions 8, in the ducts 21 and in the pipes 16, 17 are indicated by arrows. The steam supplying unit of the improved apparatus 1 supplies steam at a pressure which suffices to ensure that steam flows from the channel 12 toward and into the channel 13 as well as to ensure that steam flowing from the channel 13 into the conduits 24 can enter the respective chambers 2 by way of the associated valves 10 and to be sufficiently compressed to leave the chambers 2 via apertures 23 in the respective portions of the first wall 3. The pressure in the treating zone 27, in turn, suffices to ensure adequate treatment of (expulsion of moisture from) successive increments of the running web 22.

As disclosed in U.S. Pat. No. 5,059,285 to Winheim, the axes of orifices or ports 25 in the valves 10 are inclined relative to the adjacent walls 4 to 7 and partitions 8 at angles A of preferably between 69° and 75°. The bodies of the valves 10 which are shown in the drawings constitute or resemble upright cylinders whose axes are normal or nearly normal to the walls 3 and 9 (it being assumed here that the walls 3, 9 are horizontal or nearly horizontal and that the path for the web 22 is located at a level beneath and is substantially parallel to the first wall 3). The chambers 2 have a substantially rectangular outline (note FIG. 3). The aforementioned angles A=69°-75° apply only for the axes of those orifices 25 which are located in a plane extending at right angles to the walls 4 to 7 and partitions 8. For all other orifices, the angle A must be projected into the corresponding plane.

All such constituents of the improved apparatus which convey steam (this applies in particular for the channels 12 and 13) are surrounded by jackets 26 of suitable heat insulating material which is shown in FIG. 1 but is omitted in FIGS. 2 and 3 for the sake of clarity.

FIG. 1 shows that portions of the channels 12 and 13 extend toward the path for the web 23 beyond the first wall 3 of the housing of the improved apparatus 1. Such portions of the channels 12, 13 cooperate with the first wall 3 to define the aforementioned treating zone 27 which is located between the exposed side or surface of the wall 3 and the adjacent side of the path for the running web 22. The treating zone 27 permits some expansion of jets of steam which leaves the chambers 2 through the respective groups of apertures 23. The zone 27 further serves to ensure an equalization of pressures of jets of steam which leave the respective chambers 2 on their way toward contact with the running web 22. The front portions of the channels 12, 13 which extend beyond the first wall 3 toward the path for the web 22 serve the additional purpose of ensuring adequate heating of those portions of the housing of the apparatus 1 which are shown in FIG. 1, as at 28 and 29, i.e., the portions which are remotest from the chambers 2 and nearest to the web 22.

The channel 12 serves as a means for effecting at least some (initial) drying of steam which is on its way from the source 116 and pipe 16 into the channel 13. The source 116 can constitute or include a steam boiler. Heating of steam in the channel 12 is particularly desirable and advantageous if the path for the flow of fresh steam from the source 116 into the sections or channels 13, 14 is long or extremely long. The body of steam flowing from the source 116, in an elongated pipe 16, and thence into the channel 12 can or is apt to undergo at least some condensation so that the discharge end of the conduit 16 is likely to deliver at least some droplets of condensed steam. The channel 12 effects reheating of steam therein so that the body of steam entering the channel 14 is at least substantially free of condensate. Thus, by the simple expedient of designing the first channel 12 as a means for heating the body of steam therein, one can ensure that the channel 14 (and hence also the channel 13) can receive steam which does not contain condensate. Therefore, the thus dried steam can be admitted into the conduits 24 and valves 10 and thence into the chambers 2 to be discharged into the treating zone 27 and to expel moisture from the running web 22.

FIG. 2 shows a portion of a pipe 33 which serves to evacuate condensate (if any) from the deepmost portion of the channel 14. Pipes 30, 32 are respectively provided in the lower portions of the channels 13 and 12 to evacuate condensate (if any) from the respective zones of the means for heating the housing and the contents of the chambers 2 in the apparatus 1. Further pipes 31 are provided at the inner or upper side of the first wall 3 to evacuate condensate from the chambers 2. The pipes 30 to 33 evacuate condensate (if any) if the apparatus is set up as shown in the drawings, i.e., with the first wall 3 of the housing located at a level above the path for the web 22. Additional pipes 34, 35, 36 for evacuation of condensed steam are provided in the upper portions of the channel 13, chambers 2 and channel 12, respectively (see FIG. 1). The pipes 34 to 36 are put to use if the apparatus 1 is installed in inverted condition, i.e., with the first wall 3 located at a level below the path for the web 22. The positions of the pipes 30–33 and 34–36 are then interchanged, i.e., the pipes 34–36 are located in the lowermost portions of the channel 13, chambers 2 and channel 12, respectively. An additional evacuating pipe (not shown) for condensed steam can also be provided in the channel 14 at a level above the pipe 33 as viewed in FIG. 2. FIG. 2 shows that the pipe 37 comprises a siphon 37 which can be put to use in a manner to be described below when the apparatus 1 is operated in inverted condition (with the wall 3 located beneath the path for the web 22). That chamber 2 which communicates with the inlet of the pipe 35 can discharge condensed steam (if any) into the siphon 37. The siphon 37 contains at least one column of liquid in a manner and for reasons which are well known from the art of siphons. The liquid which is confined in the siphon 37 prevents the escape of steam from the respective chamber 2 through the pipe 35. Thus, the liquid column in the siphon 37 is sufficiently high to ensure that the body of steam which is confined in the respective chamber 2 cannot escape via pipe 35 but only through the respective apertures 23 in the adjacent portion of the first wall 3. This holds true even though the chamber 2 which communicates with the inlet of the pipe 35 contains a body of steam at a certain pressure which is selected and variable by the respective adjusting device 11 in order to ensure the establishment of optimum steam pressure in the treating zone 27 beneath the path for the web 22. However, if the pipe 35 receives from the corresponding chamber 2 a supply of condensed steam (normally water), such condensed steam merges into the column of liquid in the siphon 37 and the latter discharges a corresponding amount of liquid into the system which collects condensed steam from the pipes 30–33 or 34–36 (depending on the position of the apparatus 1 relative to (above or below) the path for the web 22). Outflow of liquid from the siphon 37 is terminated when the state of equilibrium is reestablished.

A siphon 37 is or can be provided in each of the pipes 30 to 36; only one siphon 37 has been shown (in FIG. 2) for the sake of clarity.

The temperature of steam which is admitted into the housing of the apparatus 1 is preferably selected in such a way that the walls 3–9 are heated to a temperature of 102°–110° C. as a result of flow of steam in the channels 12–14 and ducts 19, 21. Such temperature suffices to prevent deposition of condensate on the walls 3 to 9.

As mentioned above, the entire body of steam which is confined in and flows within the housing of the improved apparatus 1 is continuously maintained at a predetermined optimum pressure which can be selected and varied by the valves 10, i.e., by the adjusting devices 11 for these valves. The valves 10 and their adjusting devices 11 further determine the rate of flow of steam into the treating zone 27 and hence into contact with the running web 22. The adjusting devices 11 are preferably designed to permit highly accurate regulation of steam pressure, and to thus ensure that the running web 22 can be contacted by small or very small quantities of steam per unit of time, e.g., in the range of 1 to 10 kilograms per hour, i.e., only by a few cubic meters of steam per hour. The steam pressure in the housing of the apparatus 1 can be in the range of 1.2 to 1.3 bar.

The improved apparatus is susceptible of many additional modifications without departing from the spirit of the present invention. For example, the ducts 21 can be provided at the inner side of the first wall 3, i.e., in the interior of the respective chambers 2. This may be desirable and advantageous if it is important or necessary that the exposed external surface of the wall 3 remain smooth. It is further possible to replace the illustrated partitions 8 with twin-walled partitions which establish passages for the flow of steam between the channels 12 and 13; this renders it possible to dispense with the U-shaped portions 18 of the ducts 19. It is further possible to reduce the number of chambers 2 to three, two or one, or to increase their number to five or more.

An important advantage of the improved apparatus 1 is that it greatly reduces the likelihood of condensation of steam, not only when the apparatus is in actual use at a level above or below the path of the running web 22 but also when the apparatus is temporarily idle, e.g., in a calender wherein certain rolls must be replaced at regular or random intervals. This is due to the fact that the heated wall or walls of the housing of the improved apparatus are capable of exchanging sufficient amounts of heat with the contents of the chambers 2 to thus ensure that the rate of condensation is much lower than in heretofore known apparatus. The contents of the chambers 2 are maintained at a requisite elevated temperature when the apparatus 1 is in use as well as when the apparatus is idle. Consequently, fresh steam which is admitted via pipe 16 when the apparatus 1 is restarted need not be utilized to heat the contents of the chambers 2 because such contents remain at the desired optimal temperature also while the apparatus is idle. Thus, steam which is admitted when the apparatus 1 is restarted is ready to leave the chambers 2 through the respective groups of apertures 23 and the thus formed jets are intermixed to form a homogeneous body which contacts successive increments of the running web 22. It has been found that the likelihood of condensation of steam in the chambers 2 and/or in the treating zone 27 upon restarting of the apparatus 1 is much less pronounced than during restarting of conventional apparatus. Therefore, the web 22 is less likely to be damaged (such as perforated) when the admission of fresh steam from the source 114 into the chambers 2 (and thence into contact with the web 22 via treating zone 27) is resumed irrespective of the duration of the period of idleness of the improved apparatus. In other words, the improved apparatus can remain idle for extended periods of time, and this does not enhance the likelihood of damage or more pronounced damage to the web when the operation is resumed.

Another important advantage of the improved apparatus is that the steam can be dried and one or more walls of the housing of the apparatus can be heated with steam, i.e., it is not necessary to employ an additional carrier of energy, such as electric current. This not only simplifies the construction and servicing of the improved apparatus but also reduces the possibility of injury to the person or persons in charge and results in savings in energy Steam must be available anyway since it is used to contact the web 22 so that the utilization of an available energy carrier evidently entails substantial savings is compared with apparatus wherein one or more walls of the housing are heated by a discrete second energy carrier, such as electric current. However, it is within the purview of the present invention to employ steam as a means for treating the running web 22 and to employ one or more electrically operated devices as a means for heating one or more walls of the housing and/or for drying steam prior to admission into the chamber or chambers 2.

A further important advantage of the improved apparatus is its simplicity. Thus, the channels 12 and 13 can form the legs of a substantially U-shaped composite channel of the heating means, and the channels 12, 13 are located at opposite sides of the row of chambers 2 so that the walls for each of these chambers can be heated by steam flowing in the channel 12 as well as by steam flowing in the channel 13. The web or base of the composite U-shaped channel is formed by the channel 14 which connects the discharge end of the steam drying channel 12 with the receiving end of the channel 13. In other words, the composite heating channel 12-14 is designed to heat at least two walls for each of the chambers 2. As already mentioned above, the purpose of the channel 12 is to dry the mass of steam flowing from the source 114 toward and into the channel 14 and to thus evaporate any droplets of liquid which develop as a result of cooling of steam in the pipe 16, especially if the source 116 is or must be located at a considerable distance from the channel 12. Such drying of steam in the channel 12 ensures that the mass of steam which enters the channel 13 to flow into the chambers 2 through the respective conduits 24 and valves 10 (at a rate determined by the selected setting of the respective adjusting devices 11) is free of condensate and that steam which is used to heat the walls around the chambers 2 is also free of condensate, at least in the channels 14 and 13 and preferably also in the ducts 19 and 21. Absence of droplets of condensed steam in the conduits 24 ensures that the treating zone 27 is highly unlikely to receive from the chambers 2 any condensate or any appreciable quantities of condensate such as could adversely affect the treatment of the running web 22.

The provision of a common steam supplying conduit 16 for the heating means 12–14 and for the other parts (24, 10 and 11) of the means for supplying steam to the chambers 10 also contributes to simplicity, lower cost and reliability of the improved apparatus 1. A single source (e.g., a boiler) of steam suffices to meet the requirements of the steam heating means as well as the requirements of the means for supplying steam to the treating zone 27 in order to contact the running web 22.

Though it is desirable to heat the entire housing or at least the major portion of the housing, it is equally within the scope of the invention to heat only certain walls or wall portions which surround the chambers 2. For example, it often suffices to heat only the first wall 3 (in addition to heating of the walls 4 to 8 by steam in the channels 12 to 14). Heating of the first wall 3 is considered to be desirable and advantageous on the ground that any droplets of condensate which happen to penetrate into or which develop in the chambers 2 are bound or likely to be propelled against the inner side of the wall 3. The liquid of such droplets is caused to evaporate not later than during passage through the respective groups of apertures 23 on its way into the treating zone 27.

The feature that the ducts 19 and 21 are formed in part by the walls (8 and 3)(which are being heated by steam flowing therethrough) contributes to more intensive heating of the respective walls and to savings in energy. Thus, steam flowing in the ducts 19 and 21 can exchange heat directly with the adjacent portions of the respective walls 8 and 3.

Though it is possible or conceivable to depart from that orientation of the channels 12, 13 which was described hereinabove and is shown in the drawings (so that the channels 12 and 13 extend transversely of the direction which is indicated by the arrow D, i.e., in parallelism with the row of chambers 4), the illustrated orientation of the channels 12 and 13 is preferred for several reasons. Thus, each of these channels can heat at least one wall bounding each and every chamber 2. Secondly, such orientation of the channels 12, 13 ensures, or at least renders it likely, that the contents of all chambers are heated to the same extent or that the temperature of the contents of such chambers is maintained within a rather narrow range. This, in turn, ensures more reliable homogenization of steam which fills the treating zone 27 and comes in actual contact with the running web 22.

The walls of the housing of the apparatus 1 are relatively thin in order to reduce the overall weight of the apparatus as well as to ensure more satisfactory exchange of heat between the body of steam at the outer sides of such walls and the contents of the respective chambers 2. This is the reason that, in accordance with a presently preferred embodiment of the invention, the ducts 19 and 21 are not provided in the respective walls but are formed by employing substantially U-shaped duct portions 18 and 20 which are welded or otherwise reliably bonded or affixed directly to the adjacent selected portions of the walls 8 and 3. Furthermore, the ducts 19 and 21 ensure that the streams of steam which are used to heat the partitions or walls 8 cannot penetrate into the adjacent chambers 2 as well as that the streams of steam in the ducts 21 cannot mix with steam which enters the treating zone 27 through the apertures 23 of the first wall 3. As can be seen in FIG. 3, the steam receiving ends of the ducts 21 communicate with the channel 14 and the steam discharging ends of these ducts communicate with the downstream portion of the channel 13. This ensures the establishment of a pressure differential between the receiving and discharging ends of each duct 21 with attendant flow of steam in directions transversely of the direction which is indicated by the arrow D, i.e., in substantial parallelism with the flow of steam in the channel 13. Such distribution of ducts 21 and such flow of steam in these ducts ensure at least substantially uniform heating of the entire first wall 3 and hence an even more reliable reduction of the likelihood of penetration of droplets of condensed steam into the treating zone 27 and thence into contact with the web 22. The feature that the groups of apertures 23 in the first wall 3 alternate with the ducts 21 ensures that the heating action of steam in the ducts 21 is not adversely or uncontrollably influenced by jets of steam which leave the chambers 2 through the respective apertures 23 to enter the treating zone 27. In other words, one achieves a reliable sealing or segregation of steam which is used to treat the running web 27 from steam which is used to heat the housing (wall 3) of the apparatus 1.

If the transverse wall 9 of the housing is not specifically heated, but if the partitions or walls 8 are heated in a manner as shown for the partition 8 of FIG. 2, five out of six walls or wall portions bounding each of the chambers 2 are heated by steam to thus ensure predictable evaporation of any droplets which happen to penetrate into or to develop in the chambers before the droplets can enter the treating zone 27 This is desirable and advantageous because it is not necessary to heat a single wall or only two walls around each of the chambers 2 to a high or very high temperature. In other words, moderate heating of all or nearly all walls achieves the same result, namely adequate heating of the contents of the chambers 2 to prevent damage to or destruction of a considerable length of the web 22 when the operation of the apparatus 1 is resumed after a relatively short or after a longer or long period of idleness, e.g., in a calender wherein one or more rolls (such as soft rolls) must be inspected, treated or replaced at certain or random intervals. Heating of a large number of walls (or of each wall) of the housing forming part of the improved apparatus ensures that the temperature gradient in each of the chambers 2 is relatively flat.

Though it is possible to provide a single adjusting device 11 for all of the valves 10 or to provide a discrete adjusting device 11 for sets of valves 10, the provision of discrete adjusting devices 11 for all of the valves 10 is preferred at this time because this expedient renders it possible to accurately regulate the quantity and/or pressure of steam in the respective chambers 2 across the full width of the running web 22. This renders it possible to select and/or alter the moisture content profile of the web within a desired range.

The advantages of valves with orifices or ports 25 whose axes are inclined relative to certain walls of the respective portions of the housing at angles A of at least 60°, preferably at angles of 69°-75°, are pointed out and claimed in U.S. Pat. No. 5,059,285. Thus, even though a stream of steam issuing from an orifice 25 at an angle A of at least 60° will have a large component in a direction toward the respective wall, the stream is caused to rebound upon impingement against the respective wall at a highly satisfactory angle which ensures uniform distribution of steam in the respective chamber 2. Uniform distribution of steam in the chambers 2 ensures the development of a uniform steam exit profile at the corresponding portions of the first wall 3, i.e., the velocity of jets of steam issuing from the apertures 23 of the wall 3 is the same or nearly the same. Thus, it is not necessary to carry out additional special undertakings in order to reduce the velocity of those jets of steam which could adversely affect the quality of the web 22. Uniform distribution of steam in the chambers 2 renders it possible to maintain the steam in these chambers at a relatively low pressure which is desirable for many reasons, for example, because the jets of steam issuing from the chambers 2 through the respective apertures 23 generate less noise.

The provision of pipes 30 to 36 for evacuation of condensed steam from the channels 12-14 and chambers 2 exhibits the advantage that a high percentage of condensed steam (if any) can escape from the respective channels and chambers irrespective of the orientation of the apparatus 1, i.e., in upright position (as shown) at a level above the path for the web 22 or in inverted condition beneath such path. This ensures that the improved apparatus is ready to treat a running web in an optimal way immediately or very soon subsequent to resumption of operation of the apparatus in a paper making machine or in a calender. In other words, it takes a very short interval of time to reliably expel or evaporate all traces of condensed steam in the chambers 2 and channels 12-13 when the pipe 16 is again free to convey fresh steam from the source 116 into the channel 12.

The advantages of the siphons 37 (preferably one in each of the pipes 30-36) were pointed out hereinabove. The columns of liquid in these siphons permanently prevent the escape of steam as long as the steam pressure does not exceed a preselected optimal pressure. At the same time, such liquid columns do not prevent but permit ready expulsion of condensed steam from the respective chambers and channels.

The advantages of the feature that the transverse dimensions of the apertures 23 do not exceed the thickness of the first wall 3 are described in connection with FIG. 13 in U.S. Pat. No. 4,915,788 to Windheim. Thus, it is possible to ensure that the jets of steam issuing from the chambers 2 flow in predetermined directions on their way through and beyond the first wall 3. This, in turn, renders it possible, to ensure the establishment of more predictable and more satisfactory contact between the body of steam in the treating zone 27 and the running web 22.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for contacting with steam a running web which is advanced in a predetermined direction along a predetermined path, comprising a housing defining at least one steam confining chamber, said housing including a first wall at one side of said path and having apertures arranged to direct steam from said at least one chamber toward the web in said path, said housing further having additional walls cooperating with said first wall to enclose said at least one chamber; means for supplying steam into said at least one chamber including a valve disposed n said at least one chamber, a source of steam and means for conveying steam from said source to said valve; and steam-operated means for heating at least one wall of said housing to oppose condensation of steam in said at least one chamber, said heating means including a steam drying first section extending in a second direction substantially transversely of said predetermined direction, a second section extending in a third direction substantially transversely of said predetermined direction and substantially counter to said second direction, said at least one chamber being disposed between said sections and said heating means further comprising a third section connecting said first section with said second section.

2. Apparatus for contacting with steam a running web which is advanced in a predetermined direction along a predetermined path, comprising a housing defining at least one steam confining chamber, said housing including a first wall at one side of said path and having apertures arranged to direct steam from said at least one chamber toward the web in said path, said housing further having additional walls cooperating with said first wall to enclose said at least one chamber; means for supplying steam into said at least one chamber, a source of steam and means for conveying steam from said source to said valve; and steam-operated means for heating at least one wall of said housing to oppose condensation of steam in said at least one chamber, said heating means including a steam drying first section extending in a second direction substantially transversely of said predetermined direction, a second section extending in a third direction substantially transversely of said predetermined direction, a second section extending in a third direction substantially transversely of said predetermined direction and substantially counter to said second direction, said at least one chamber being disposed between said sections and said heating means further comprising a third section connecting said first section with said second section, wherein each of said sections comprises a channel and said channels together define a substantially u-shaped second path for the flow of steam around said housing.

3. Apparatus for contacting with steam a running web which is advanced in a predetermined direction along a predetermined path, comprising a housing defining at least one steam confining chamber, said housing including a first wall at one side of said path and having apertures arranged to direct steam from said at least one chamber toward the web in said path, said housing further having additional walls cooperating with said first wall to enclose said at least one chamber; means for supplying steam into said at least one chamber, a source of steam and means for conveying steam from said source to said valve; and steam-operated means for heating at least one wall of said housing to oppose condensation of steam in said at least one chamber, said heating means including a steam drying first section extending in a second direction substantially transversely of said predetermined direction, a second section extending in a third direction substantially transversely of said predetermined direction, a second section extending in a third direction substantially transversely of said predetermined direction and substantially counter to said second direction, said at least one chamber being disposed between said sections and said heating means further comprising a third section connecting said first section with said second section, wherein said sections form part of said conveying means and said valve receives dried steam from said second section.

4. The apparatus of claim 1, wherein said at least one wall is said first wall.

5. The apparatus of claim 1, wherein at least one of said sections is adjacent said at least one wall.

6. The apparatus of claim 1, wherein said housing defines a plurality of neighboring chambers arranged in a row extending substantially transversely of said predetermined direction and said additional walls include partitioning means between neighboring chambers, said steam supplying means including a valve in each of said chambers and at least one of said sections being adjacent the entire row of said chambers.

7. The apparatus of claim 1, wherein said second section is elongated and comprises a first end and a second end, said heating means further comprising means for establishing a pressure differential between said ends.

8. The apparatus of claim 1, wherein said heating means further comprises at least one duct disposed at said first wall and having an inlet receiving dried steam from one of said sections.

9. The apparatus of claim 8, wherein said at least one duct includes a substantially U-shaped first portion and a second portion forming part of said first wall and defining with said first portion an elongated passage for dried steam.

10. The apparatus of claim 8, wherein said apertures form at least two groups and said at least one duct is disposed between said groups.

11. The apparatus of claim 1, wherein said housing defines a plurality of chambers and said walls include partitioning means disposed between said chambers, said heating means further comprising at least one duct provided at said partitioning means and communicatively connecting said first section with said second section.

12. The apparatus of claim 1, wherein said first wall is spaced apart from said predetermined path and said first and second sections have portions extending beyond said first wall toward said predetermined path.

13. Apparatus for contacting with steam a running web which is advanced in a predetermined direction along a predetermined path, comprising a housing defining at least one steam confining chamber, said housing including a first wall at one side of said path and having apertures arranged to direct steam from said at least one chamber toward the web in said path, said housing further having additional walls cooperating with said first wall to enclose said at least one chamber; means for supplying steam into said at least one chamber, a source of steam and means for conveying steam from said source to said valve; and steam-operated means for heating at least one wall of said housing to oppose condensation of steam in said at least one chamber, said heating means including a steam drying first section extending in a second direction substantially transversely of said predetermined direction, a second section extending in a third direction substantially transversely of said predetermined direction, a second section extending in a third direction substantially transversely of said predetermined direction and substantially counter to said second direction, said at least one chamber being disposed between said sections and said heating means further comprising a third section connecting said first section with said second section, wherein said housing defines a plurality of chambers and said supplying means comprises an adjustable valve for each of said chambers, said supplying means further comprising means for adjusting said valves independently of each other.

14. The apparatus of claim 1, wherein said valve has a plurality of steam discharging orifices having axes which define with at least one of said additional walls angles of 69°-75°.

15. Apparatus for contacting with steam a running web which is advanced in a predetermined direction along a predetermined path, comprising a housing defining at least one steam confining chamber, said housing including a first wall at one side of said path and having apertures arranged to direct steam from said at least one chamber toward the web in said path, said housing further having additional walls cooperating with said first wall to enclose said at least one chamber; means for supplying steam into said at least one chamber, a source of steam and means for conveying steam from said source to said valve; and steam-operated means for heating at least one wall of said housing to oppose condensation of steam in said at least one chamber, said heating means including a steam drying first section extending in a second direction substantially transversely of said predetermined direction, a second section extending in a third direction substantially transversely of said predetermined direction, a second section extending in a third direction substantially transversely of said predetermined direction and substantially counter to said second direction, said at least one chamber being disposed between said sections and said heating means further comprising a third section connecting said first section with said second section, wherein said additional walls include a transverse wall disposed substantially opposite said first wall, and further comprising means for evacuating condensed steam, if any, from said at least one chamber in the region of at least one of said first and transverse walls.

16. The apparatus of claim 15, wherein said supplying means includes means for normally maintaining steam in said at least one chamber at a predetermined pressure and said evacuating means includes a siphon having a length which suffices to establish and maintain a column of condensed steam which can resist said predetermined pressure of steam in said at least one chamber.

17. The apparatus of claim 1, wherein said first wall has a predetermined thickness and each of said apertures has a maximum dimension which at most equals said thickness.

18. The apparatus of claim 17, wherein said apertures are substantially round and have diameters smaller than said thickness.

19. The apparatus of claim 1, wherein said heating means includes means for maintaining said at least one wall at a temperature of between 102° and 110° C.

* * * * *